US006523759B1

(12) United States Patent
D'Arrigo

(10) Patent No.: US 6,523,759 B1
(45) Date of Patent: Feb. 25, 2003

(54) ADJUSTABLE ANTI-BOUNCE ARMATURE DISK

(75) Inventor: Angelo D'Arrigo, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/604,401

(22) Filed: Jun. 27, 2000

(51) Int. Cl.[7] ..... B05B 1/30

(52) U.S. Cl. ..... 239/585.1; 239/585.4; 251/129.21

(58) Field of Search ..... 239/533.8, 533.9, 239/533.15, 585.1, 585.4, 585.2, 585.3, 533.1, 533.2; 251/129.21, 129.18, 129.15, 282

(56) References Cited

U.S. PATENT DOCUMENTS

| | | | | |
|---|---|---|---|---|
| 5,284,302 A | | 2/1994 | Kato et al. | 239/585.1 |
| 5,288,025 A | | 2/1994 | Cerny | 239/533.8 |
| 5,961,052 A | | 10/1999 | Coldren et al. | 239/585.1 |
| 6,257,508 B1 | * | 7/2001 | Wieczorek et al. | 239/533.8 |

FOREIGN PATENT DOCUMENTS

| | | |
|---|---|---|
| DE | 2416804 | 10/1975 |
| WO | WO 9309344 | 12/1992 |

* cited by examiner

*Primary Examiner*—Lisa A. Douglas

(57) ABSTRACT

A fuel injector having a reduced bounce armature is disclosed. The fuel injector includes an upstream end, a downstream end, and a valve seat located at the downstream end. The armature located between the upstream end and the downstream end and includes an upstream armature end; a downstream armature end; and a longitudinal channel extending therethrough. The longitudinal channel includes an upstream portion having a first cross-sectional area and a downstream portion having a second cross-sectional area, with the second cross-sectional area being smaller than the first cross-sectional area. The downstream portion includes at least one interior wall. The armature also includes a flow restrictor element inserted into the downstream portion of the longitudinal channel such that liquid flow from the downstream armature end to the upstream armature end is restricted. The fuel injector further includes a needle located in the longitudinal channel downstream of the transverse channel. The needle extends from the longitudinal channel and is reciprocably engageable with the valve seat in a closed position. A method of reducing the bounce of the armature is also disclosed.

17 Claims, 5 Drawing Sheets

ADJUSTABLE ANTI-BOUNCE ARMATURE DISK

FIELD OF THE INVENTION

The present invention relates to an apparatus and a method for reducing and/or eliminating armature/needle bounce during operation.

BACKGROUND OF THE INVENTION

During operation of High Pressure Direct Injection (HPDI) fuel injectors, armature/needle assembly closing action during the closing phase of the duty cycle is followed immediately by a secondary shorter reopen and closing phase called "bounce". During this secondary reopen phase, additional, unwanted fuel is dispensed from the fuel injector. To improve high pressure fuel injector performance, the bounce must be minimized, or more preferably, eliminated.

One aspect of injector performance which has been addressed to reduce or eliminate bounce has been the flow of fuel through the armature. To solve the bounce problem, an anti-bounce orifice disk has been installed in the armature. The anti-bounce disk has a shape which provides a fuel path for fuel flow downstream toward the tip of the injector, but which obstructs fuel flow in the opposite, or upstream direction. Different anti-bounce orifice disks with different internal diameters are used to provide different flow rates. An anti-bounce orifice disk with a specific internal diameter is used to provide a desired flow rate. However, the specific internal diameter required is generally determined on a trial-and-error basis. This procedure requires different anti-bounce disks with different internal diameters which must be individually installed in and removed from the injector until the desired performance parameters of the injector are achieved. This process is time consuming and expensive.

It would be beneficial to provide an anti-bounce orifice disk with a single internal diameter that can be adjusted to provide different flow rates based on the axial position of the anti-bounce orifice disk within the armature/needle assembly, eliminating the costly insertion and removal of anti-bounce disks having different internal diameters.

BRIEF SUMMARY OF THE INVENTION

An armature is provided. The armature comprises an upstream end, a downstream end and a longitudinal channel extending therethrough. The longitudinal channel includes an upstream portion having a first cross-sectional area and a downstream portion having a second cross-sectional area, with the second cross-sectional area being smaller than the first cross-sectional area. The downstream portion includes at least one interior wall. The armature further comprises a flow restrictor element inserted into the downstream portion of the longitudinal channel such that liquid flow from the downstream end to the upstream end is restricted.

An armature/needle assembly is provided. The assembly includes an armature and a needle. The armature comprises an upstream end, a downstream end and a longitudinal channel extending therethrough. The longitudinal channel includes an upstream portion having a first cross-sectional area and a downstream portion having a second cross-sectional area, with the second cross-sectional area being smaller than the first cross-sectional area. The downstream portion includes at least one interior wall. The armature further comprises a flow restrictor element inserted into the downstream portion of the longitudinal channel upstream of the at least one transverse channel such that liquid flow from the downstream end to the upstream end is restricted. The needle is located in the downstream portion of the longitudical channel such that the needle extends from the longitudinal channel.

A fuel injector is also provided. The fuel injector comprises an upstream end, a downstream end, a valve seat located at the downstream end, and an armature located between the upstream end and the downstream end. The armature includes an upstream armature end, a downstream armature end, and a longitudinal channel extending therethrough. The longitudinal channel includes an upstream portion having a first cross-sectional area and a downstream portion having a second cross-sectional area, with the second cross-sectional area being smaller than the first cross-sectional area. The downstream portion includes at least one interior wall. The armature further includes a flow restrictor element inserted into the downstream portion of the longitudinal channel such that liquid flow from the downstream armature end to the upstream armature end is restricted. The fuel injector further includes a needle located in the longitudinal channel downstream of the transverse channel, with the needle extending from the longitudinal channel. The needle is reciprocably engageable with the valve seat in a closed position.

A restrictor is provided. The restrictor comprises an upstream portion including at least a first leg and a second leg. Each of the first and second legs includes an upstream end and a downstream end. The upstream end of the first and second legs are connected by a transverse connector. The upstream portion further includes an upstream opening extending between the first and second legs. The restrictor further includes a downstream portion connected to the downstream end of each of the first and second legs. The downstream portion includes a generally central opening fluidly communicating with the upstream opening.

A method of reducing reverse fluid flow through an armature in a solenoid valve is provided. The method comprises providing an armature reciprocably located within the solenoid valve, the armature having an upstream end, a downstream end, and a channel extending therethrough; inserting a flow restrictor element into the channel, the flow restrictor element allowing flow from the upstream end toward the downstream end, but restricting flow from the downstream end toward the upstream end; and operating the solenoid valve.

A method of reducing bounce in an armature/needle assembly of a fuel injector is provided. The method comprises providing an armature reciprocably located within the fuel injector, the armature having an upstream end, a downstream end, and a channel extending therethrough; inserting a flow restrictor element into the channel, the flow restrictor element allowing flow from the upstream end toward the downstream end, but restricting flow from the downstream end toward the upstream end; and operating the fuel injector.

A method of setting a fuel flow rate in a fuel injector is provided. The method comprises: a) providing a fuel injector having an armature, the armature including an upstream end, a downstream end, and a channel extending therethrough; b) inserting a flow restrictor into the channel, the flow restrictor restricting fuel flow through the channel; c) operating the fuel injector; d) measuring a fuel flow rate through the fuel injector; e) adjusting a location of the flow restrictor in the channel; f) repeating steps c-e until a desired fuel flow rate is achieved; and g) securing the flow restrictor to the armature.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
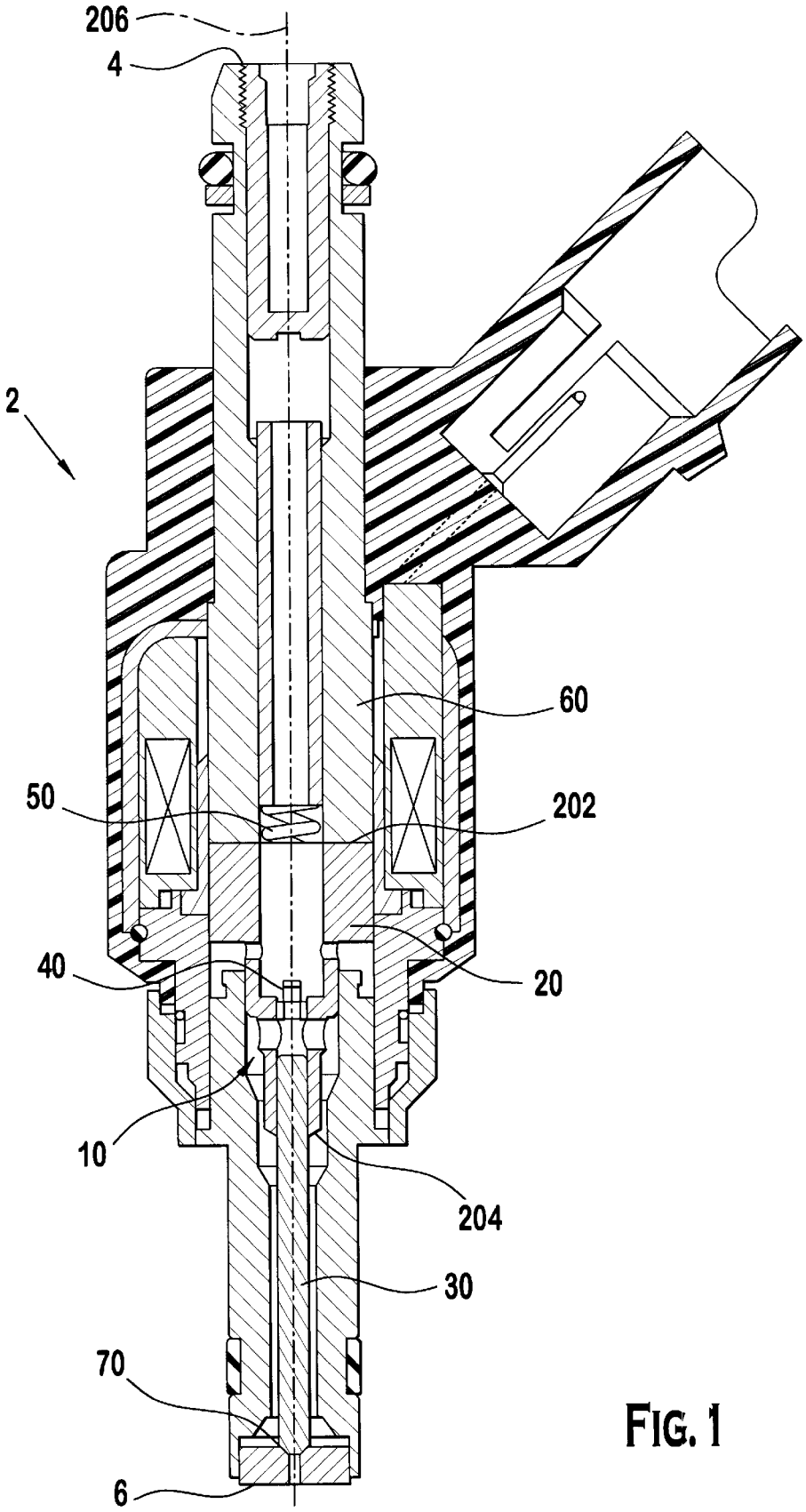
FIG. 1 is a side profile view, in section, of a fuel injector which incorporates an armature/needle assembly with the anti-bounce orifice disk according to a preferred embodiment of the present invention.

An armature/needle assembly 10 (hereinafter "assembly 10") according to the present invention is used in a high pressure direct injection (HPDI) fuel injector 2, and is shown in FIG. 1. As used herein, like numbers indicate like elements throughout. An HPDI fuel injector in which the present invention may be used is disclosed in U.S. patent application Ser. No. 09/482,059, now U.S. Pat. No. 6,257,508, which is incorporated herein by reference in its entirety. Although the present invention is preferably used in fuel injectors, those skilled in the art will recognize that the present invention can be used for other devices such as solenoid valves in which adjustable metering of a fluid is desired and/or required.

Figure 2:
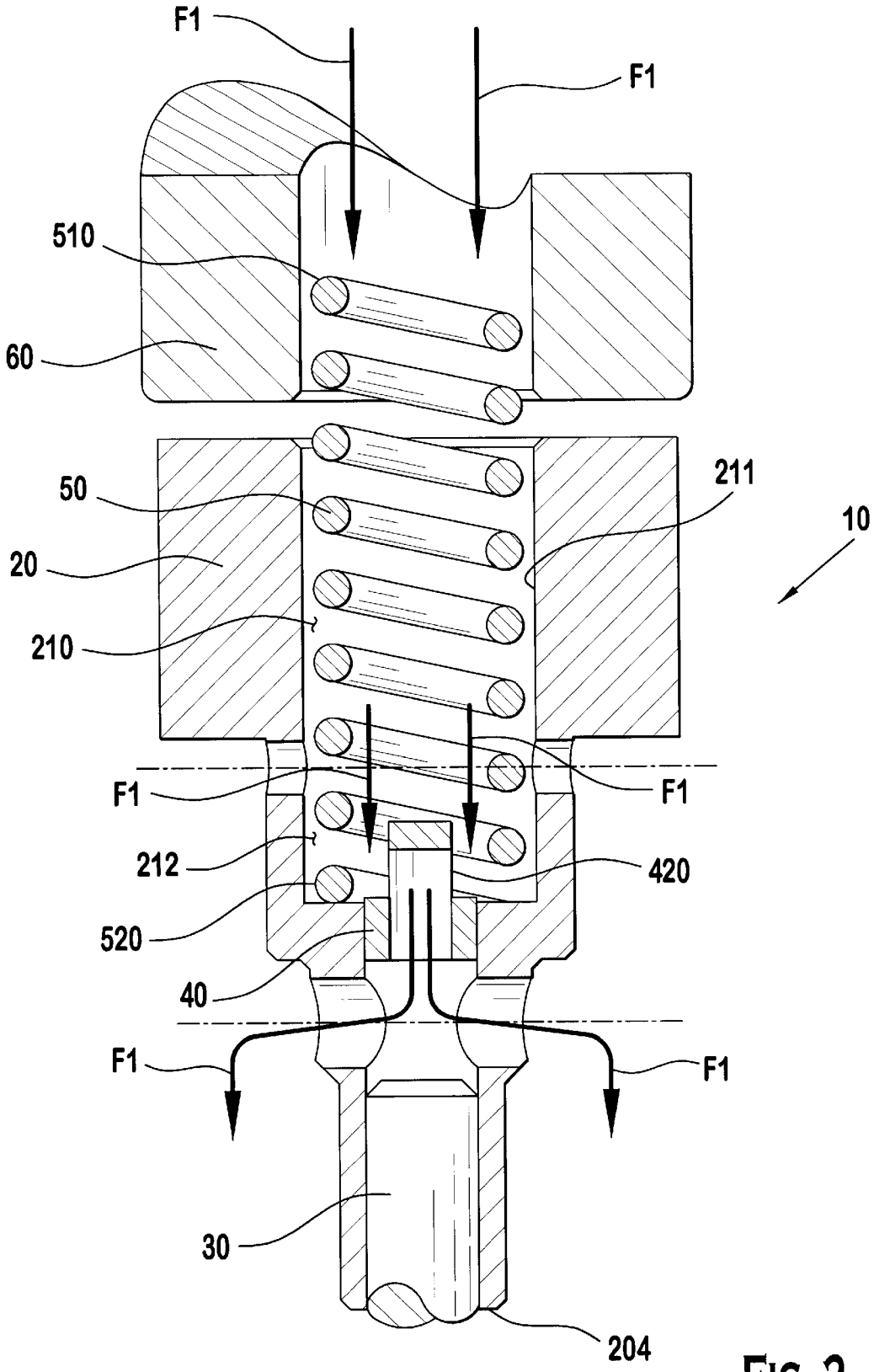
FIG. 2 is an enlarged side profile view, in section, of the armature/needle assembly with the anti-bounce orifice disk according to a first embodiment of the present invention, with the anti-bounce orifice disk in a first position.

The fuel injector 2 includes an upstream end 4, and a downstream end 6. As used herein, the terms "upstream" and "downstream" refer to directions toward the top and bottom of FIGS. 1–5, respectively. The fuel injector 2 includes an armature/needle assembly 10 (hereinafter "assembly 10") located therein between the upstream end 4 and the downstream end 4. An enlarged cross-sectional view of the assembly 10 according to the present invention is shown in FIG. 2. The assembly 10 includes an armature 20, a needle 30 and an anti-bounce orifice disk 40 (hereinafter "disk 40"). The disk 40 restricts flow of fuel from the downstream end 6 to the upstream end 4 after the fuel injector 2 closes during its operating cycle, reducing bounce of the assembly 10 after closing.

A biasing element, preferably a helical spring 50, having an upstream end 510 and a downstream end 520, is partially located within the armature 20 and biases the assembly 10 away from a fuel inlet tube 60, which is located proximate to the upstream end 4 of the fuel injector 2. The armature 20 includes an upstream end 202 and a downstream end 204. The armature 20 also includes a longitudinal axis 206 which extends through the armature 20 between the upstream end 202 and the downstream end 204. A longitudinal channel 210 extends through the armature 20 along the longitudinal axis 206 between the upstream end 202 and the downstream end 204. The longitudinal channel 210 includes an upstream portion 212 which has a first cross-sectional area $A_1$, and a downstream portion 214 which has a second cross-sectional area $A_2$. The downstream end 204 of the armature includes a ledge or lip 205 which reduces the cross-sectional size of the longitudinal channel 210 such that the second cross-sectional area $A_2$ is smaller than the first cross-sectional area $A_2$. Preferably, the second cross-sectional area $A_2$ is circular so that the downstream portion 214 of the longitudinal channel 210 includes a single, circular wall 216. However, those skilled in the art will recognize that the downstream portion 214, as well as the upstream portion 212 of the longitudinal channel 210 can be shapes other than circular, such as oblong or polygonal, and that the downstream portion 214 will have at least one wall 216.

The downstream end 204 of the armature 20 includes at least one transverse channel 220 which extends through the downstream end 204 and into the longitudinal channel 210, such that the at least one transverse channel 220 communicates the longitudinal channel 210 to the outside of the armature 20.

The needle 30 is inserted into the downstream end 204 of the armature 20 such that the needle 30 is located wholly downstream of the at least one transverse channel 220. Preferably, the needle 30 fills up the entire longitudinal channel 210 in the portion of the armature 20 in which the needle 30 is located so that any fuel or other fluid which flows downstream through the longitudinal channel 210 is directed out of the armature 20 through the at least one transverse channel 220. However, those skilled in the art will recognize that at least one longitudinal channel (not shown) can be present between the needle 30 and downstream end 204 of the armature 20, allowing some fuel or other fluid to flow out the armature 20 from other than the at least one transverse channel 220. Referring back to FIG. 1, a downstream end of the needle 30 engages a valve seat 50 at the downstream end 6 of the fuel injector 2 when the needle 30 is in a closed position.

Figure 7:
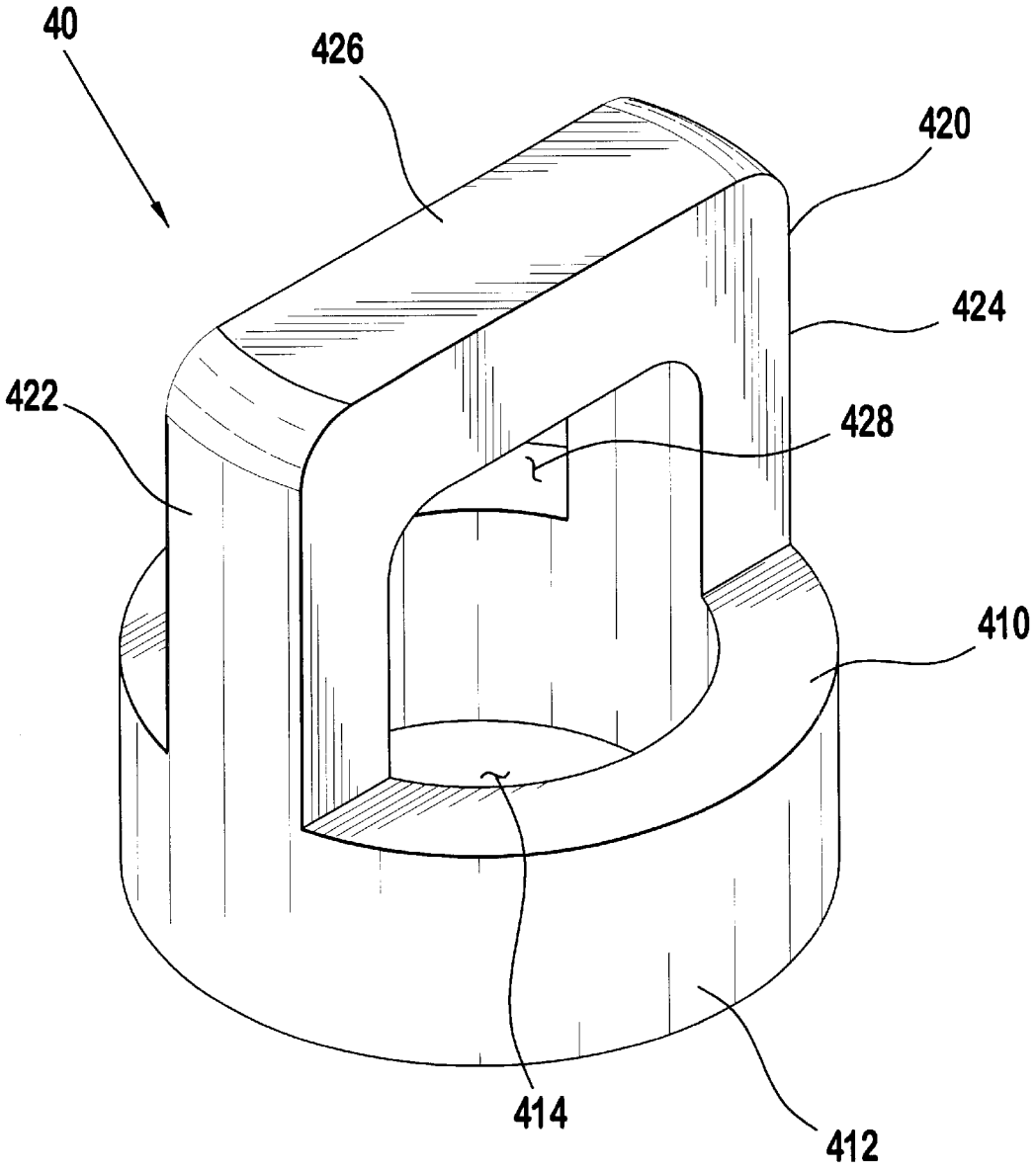
FIG. 7 is a perspective view of the anti-bounce orifice disk according to the preferred embodiment of the present invention.

Referring back to FIG. 3, the disk 40 is inserted into the armature 20 from the upstream end 202. A perspective view of the disk 40 is shown in FIG. 7. The disk 40 acts as a variable flow restrictor, restricting fuel or other fluid flow through the assembly 10. The disk 40 includes a downstream, or radial portion 410 and an upstream, or longitudinal portion 420. The radial portion 410 is preferably annularly shaped, with a generally circular sidewall 412 which is sized to conform to the at least one wall 216 which forms the downstream portion 214 of the longitudinal channel 210. Preferably, the sidewall 412 engages the wall 216 with an interference fit as will be discussed in more detail later herein. The radial portion 410 also includes a generally circular central opening 414, which is coaxial with the longitudinal axis 206 of the armature 20. The annular shape of the radial portion 410 matches the preferred circular internal diameter of the wall 216 of the downstream portion 214 of the longitudinal channel 210 so that the fuel or other fluid can flow only through the central opening 414 in the radial portion 410. However, those skilled in the art will recognize that the radial portion 410 can be any shape that allows the disk 40 to snugly engage the wall 216 so that the fuel or other fluid can flow only through the central opening 414, yet allow the disk 40 to be adjusted longitudinally in the downstream portion 214 of the longitudinal channel 210 as will be discussed in more detail later herein.

The longitudinal portion 420 is preferably generally arch shaped and includes first and second longitudinal legs 422, 424, which extend upstream from the radial portion 410. The longitudinal legs 422, 424 are connected by a transverse connector 426. Preferably, the transverse connector 426 includes a generally flat top surface, for reasons that will be explained. Although two longitudinal legs 422, 424 are preferred, those skilled in the art will recognize that additional legs (not shown) connected to the radial portion 410 and the transverse connector 426 can be used. Preferably, exterior sides 423, 425 of the longitudinal legs 422, 424, respectively, are arcuately shaped to conform with the wall 216 in an interference fit as described above with regard to the sidewall 412. A longitudinal opening 428 is located axially between the transverse connector 426 and the radial portion 410, and transversely between the two longitudinal legs 422, 424. The longitudinal opening 428 is in communication with the central opening 414.

With the above described configuration of the disk 40, fuel flows along either side of the upstream portion 420, through the longitudinal opening 428 and into the central opening 414. The length of the longitudinal legs 422, 424 is preferably selected so as not to obstruct fuel flow between the internal area of the spring 50 and the outer diameter of the disk 40.

Using an insertion tool (not shown), the restrictor 40 is inserted into the longitudinal channel 210 from the upstream end 202 of the armature 20 such that the sidewall 412 engages the wall 216 which forms the downstream portion 214 of the longitudinal channel 210.

Figure 4:
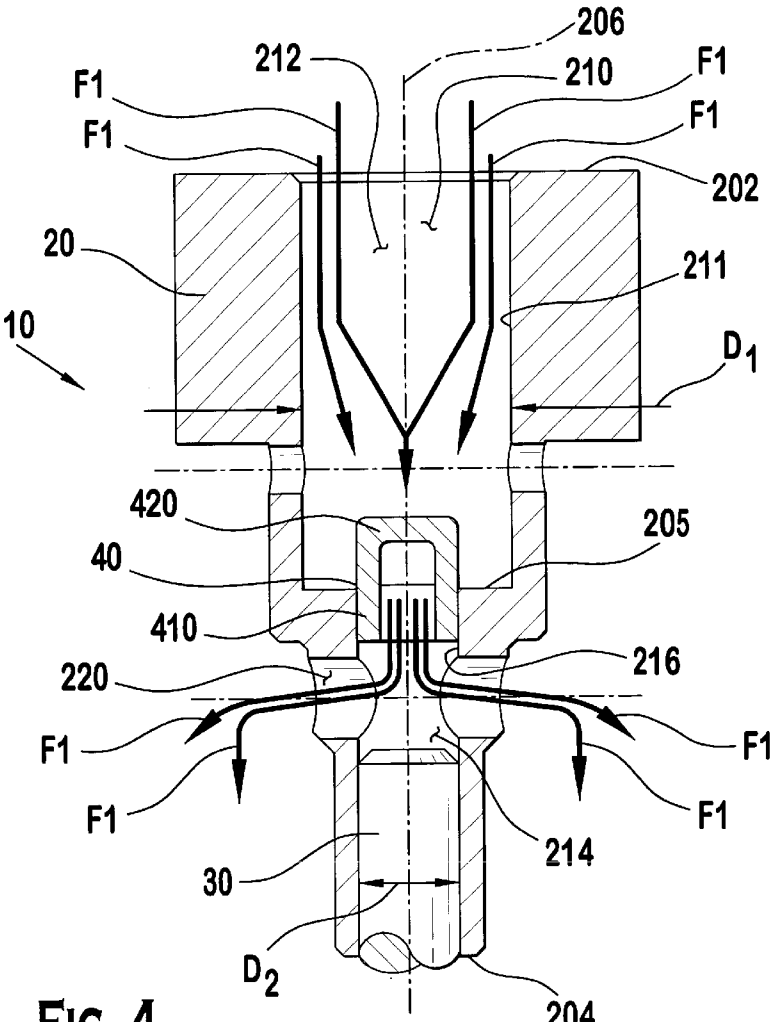
FIG. 4 is a side profile view, in section, of the armature/needle assembly with the anti-bounce orifice disk according to the preferred embodiment of the present invention, with the anti-bounce orifice disk in the first position, taken along line 3—3 of FIG. 2.
Figure 3:
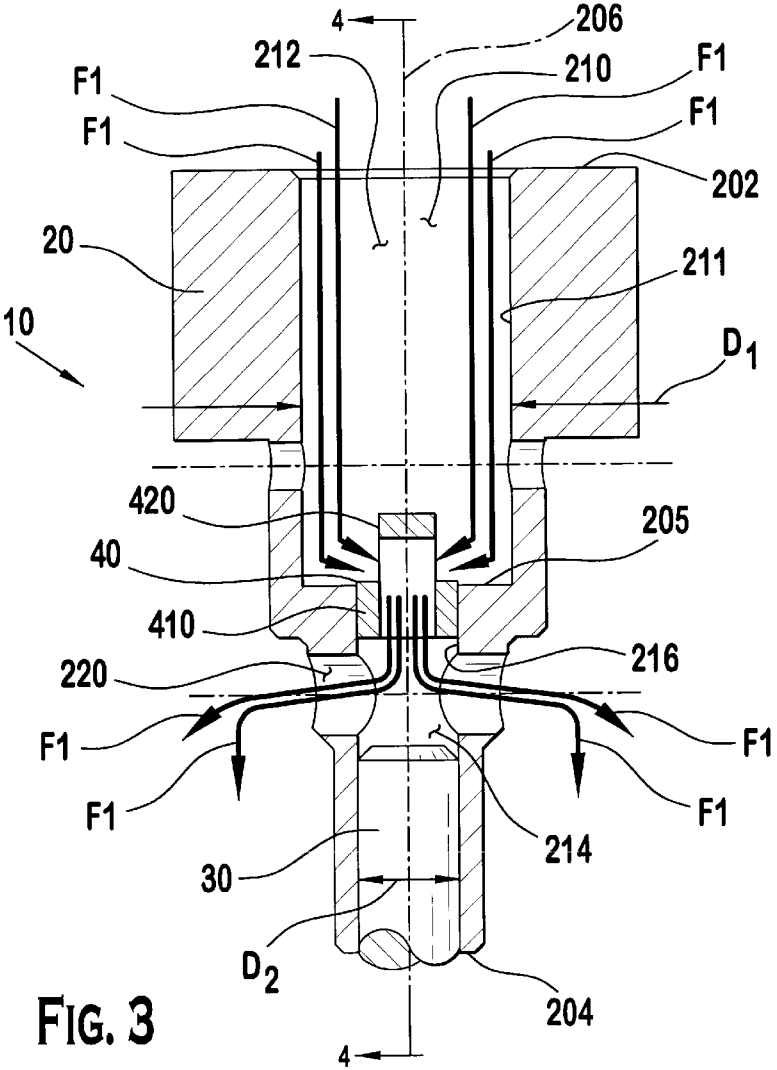
FIG. 3 is a side profile view, in section, of the armature/needle assembly with the anti-bounce orifice disk according to a preferred embodiment of the present invention, with the anti-bounce orifice disk in a first position.

As shown in FIGS. 3 and 4, the radial portion 410 of the disk 40 is located in the uppermost end of the downstream portion 214 of the longitudinal channel 210, proximate to the lip 205. In this position, the radial portion 410 does not enter into the transverse channel 220 to reduce the cross-sectional area of the transverse channel 220. Additionally, the longitudinal opening 428 communicates a maximum amount with the upstream portion 212 of the longitudinal channel 210. The position of the disk 40 in the armature 20 as shown in FIGS. 1 and 2 provides maximum flow through the assembly 10, as indicated by the flow arrows "F1".

Figure 6:
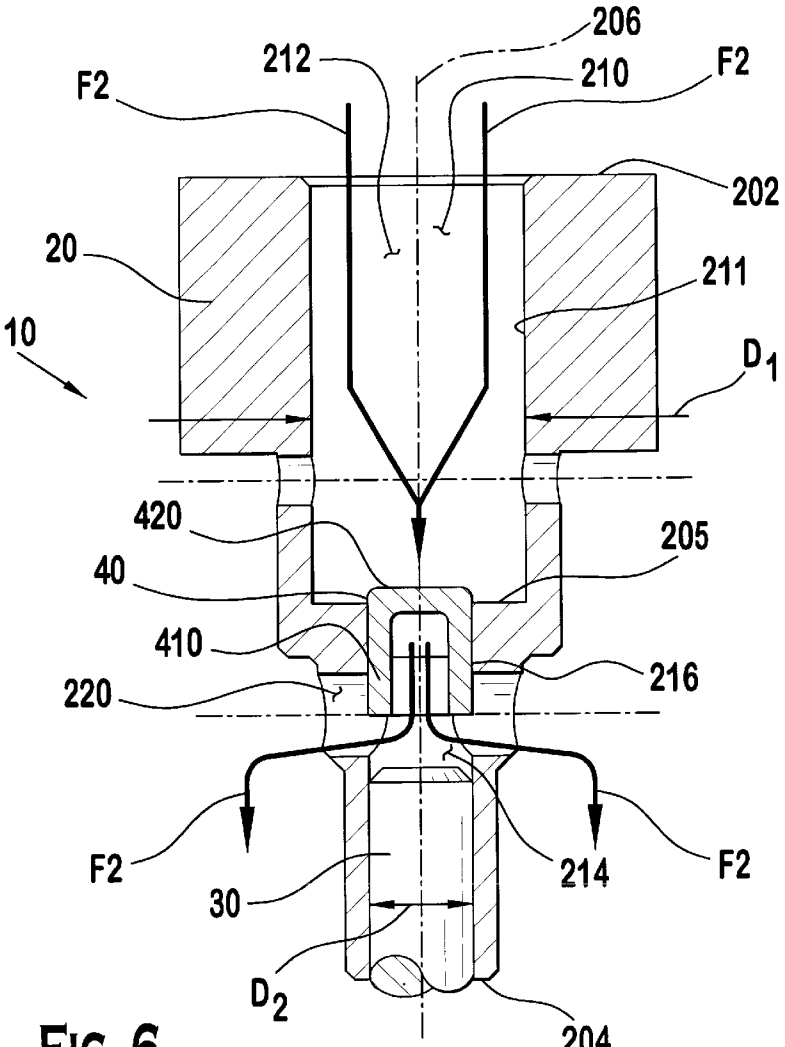
FIG. 6 is a side profile view, in section, of the armature/needle assembly with the anti-bounce orifice disk according to a preferred embodiment of the present invention, with the anti-bounce orifice disk in the second position, taken along line 6—6 of FIG. 5.
Figure 5:
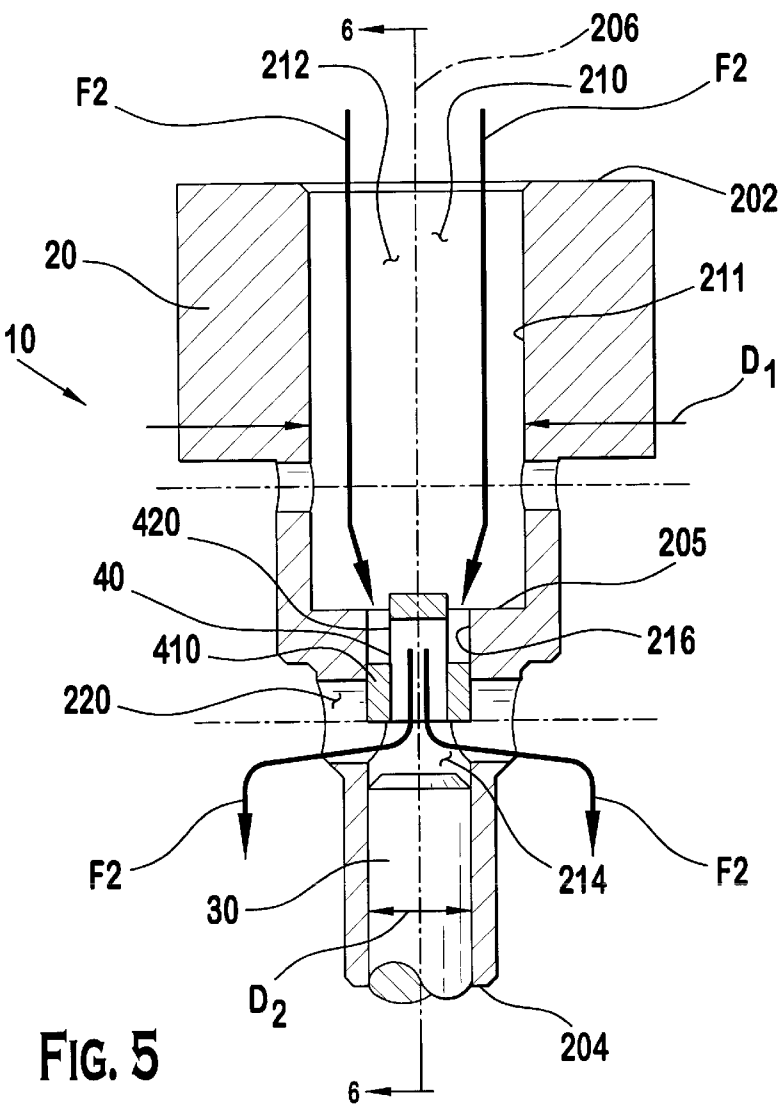
FIG. 5 is a side profile view, in section, of the armature/needle assembly with the anti-bounce orifice disk according to the preferred embodiment of the present invention, with the anti-bounce orifice disk in a second position.

To reduce fluid flow through the assembly 10 as required by the performance requirements of the particular injector, the disk 40 is preferably moved to a position in the longitudinal channel 210 downstream of the locations shown in FIGS. 3 and 4, such as to position shown in FIGS. 5 and 6. The insertion tool, or an adjusting tool (not shown) is inserted into the upstream end 202 of the armature 20 and engaged with the top, flat surface of the transverse connector 426. The adjusting tool then forces the disk 40 downstream to a desired location in the longitudinal channel 210. After the disk 40 has been moved to the desired location in the longitudinal channel 210, the tool is removed from the armature 20. The disk 40 in its new location relative to the armature 20 is shown in FIGS. 5 and 6.

As can be seen in FIGS. 5 and 6, the disk 40 is located farther downstream in the longitudinal channel 210 than in FIGS. 3 and 4. As a result, the radial portion 410 extends into the transverse channel 220, reducing the cross-sectional area of the transverse channel 220 in the area of the disk 40. Additionally, the longitudinal opening 428 is located farther downstream of the upstream portion 212 of the longitudinal channel 210, restricting flow into the longitudinal opening 428 from the longitudinal channel 210, as shown by the flow arrows "F2".

In the event that the injector performance actually obtained after setting the disk 40 in the longitudinal channel 210 is not the desired injector performance, the disk 40 can be adjusted in the longitudinal channel 210 by moving the disk 40 upstream or downstream in the longitudinal channel 210 until the desired performance of the injector is achieved. The movement of the disk 40 in the longitudinal channel 210 can be performed by trial and error without the need to remove the disk 40 and replace the disk 40 with a different sized disk.

Once the disk 40 is set in a final position in the armature 20, the disk can be permanently fixed to the armature 20 by one of several known methods, including swaging, furnace brazing, gluing, or other known methods to permanently join the parts. Alternatively, the interference fit between the disk 40 and the armature 20 may be sufficient to permanently fix the disk 40 to the armature 20.

Referring back to FIG. 2, it is seen that the downstream end 520 of the spring 50 circumscribes the longitudinal portion 420 of the disk 40. In addition to the flow regulating and anti-bounce features of the disk 40 as described above, the disk 40 can also serve to center the spring 50 in the upstream portion 212 of the longitudinal channel 210. This centering ability prevents unwanted contact between the coils in the spring 50 and the wall 211, as well as the inlet tube 60, eliminating unwanted friction during operation, and improving performance of the injector 2.

During operation of the injects 2, when the assembly 10 lifts from a valve seat (not shown), the fuel flows through the upstream portion 212 of the longitudinal channel 210, as shown by the flow arrows F1, F2 in FIGS. 3, 4 and 5, 6, respectively. If the disk 40 is located sufficiently far into the downstream portion 214 of the longitudinal channel 210 so that the downstream portion 214 is in communication with the upstream portion 212, as shown in FIGS. 5 and 6, the fuel flows into the downstream portion 214 prior to entering the disk 40.

The fuel enters the longitudinal opening 428 in the disk 40 between the longitudinal legs 422, 424, and then flows downstream through the central opening 414. If the disk 40 is in the position shown in FIGS. 3 and 4, the fuel exits from the disk 40 and enters the downstream portion 214 of the longitudinal channel 210 prior to entering the transverse channel 220. The fuel then enters the transverse channel 220 and is directed out of the armature 20 through the transverse channel 220. If the disk 40 is in the position shown in FIGS. 5 and 6, the fuel exits from the disk 40 directly into the transverse channel 220, where the fuel is directed out of the armature 20.

The shape of the disk 40 facilitates fuel flow toward the downstream end 204 of the armature 20, but restricts fuel flow toward the upstream end 202 of the armature 20 (i.e. reverse flow).

The use of a single disk 40 which can provide a wide range of fuel flows to obtain a variety of injector performance capabilities is a significant improvement over the prior known disk method which required a separate sized disk for different injector performance parameters.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined in the appended claims.

What is claimed is:

1. An armature that moves along an axis within a housing comprising:

an upstream end;

a downstream end;

a body between the upstream end and downstream end, the body configured to interact with a magnetic force so that the upstream end and downstream end move along the axis;

a longitudinal channel extending therethrough, the longitudinal channel including an upstream portion having a first cross-sectional area and a downstream portion having a second cross-sectional area, the second cross-sectional area being smaller than the first cross-sectional area, the downstream portion including at least one interior wall; and a flow restrictor element having at least a portion disposed in the downstream portion of the longitudinal channel such that liquid flow from the downstream end to the upstream end is restricted.

2. The armature according to claim 1, wherein the flow restrictor is adjustably located within the longitudinal channel.

3. The armature according to claim 2, wherein a downstream portion of the flow restrictor engages the at least one interior wall with an interference fit.

4. The armature of claim 1, wherein the flow restrictor further includes a first portion disposed in the first cross-sectional area and a second portion disposed in the second cross-sectional area of the longitudinal channel.

5. An armature comprising:

an upstream end;

a downstream end;

a longitudinal channel extending therethrough, the longitudinal channel including an upstream portion having a first cross-sectional area and a downstream portion having a second cross-sectional area, the second cross-sectional area being smaller than the first cross-sectional area, the downstream portion including at least one interior wall; and a flow restrictor element having at least a portion disposed in the downstream portion of the longitudinal channel such that liquid flow from the downstream end to the upstream end is restricted, and wherein the flow restrictor is adjustably located within the longitudinal channel and a downstream portion of the flow restrictor is located within the transverse channel.

6. An armature/needle assembly comprising:

an armature that moves along an axis within a housing, the armature including:

an upstream end;

a downstream end;

a body between the upstream end and downstream end, the body configured to interact with a magnetic force so that the upstream end and downstream end move along the axis;

a longitudinal channel extending therethrough, the longitudinal channel including an upstream portion having a first cross-sectional area and a downstream portion having a second cross-sectional area, the second cross-sectional area being smaller than the first cross-sectional area, the downstream portion including at least one interior wall; and a flow restrictor element having at least a portion disposed in the downstream portion of the longitudinal channel such that liquid flow from the downstream end to the upstream end is restricted; and a needle located in the longitudinal channel downstream of the longitudinal channel, the needle extending from the longitudinal channel.

7. The assembly of claim 6, wherein the flow restrictor further includes a first portion disposed in the first cross-sectional area and a second portion disposed in the second cross-sectional area of the longitudinal channel.

8. A fuel injector comprising:

an upstream end;

a fuel inlet tube located proximate to the upstream end;

a downstream end;

a valve seat located at the downstream end;

an armature located between the upstream end and the downstream end, the armature including:

an upstream armature end;

a downstream armature end;

a longitudinal channel extending therethrough, the longitudinal channel including an upstream portion having a first cross-sectional area and a downstream portion having a second cross-sectional area, the second cross-sectional area being smaller than the first cross-sectional area, the downstream portion including at least one interior wall; and a flow restrictor element disposed in the downstream portion of the longitudinal channel such that liquid flow from the downstream armature end to the upstream armature end is restricted; and a needle located in the longitudinal channel, the needle extending from the longitudinal channel, the needle being reciprocably engageable with the valve seat in a closed position.

9. The fuel injector according to claim 8, wherein the flow restrictor retains the biasing element away from the interior wall.

10. The fuel injector of claim 8, wherein the flow restrictor further includes a first portion disposed in the first cross-sectional area and a second portion disposed in the second cross-sectional area of the longitudinal channel.

11. The fuel injector of claim 8, wherein the flow restrictor further comprising:

an upstream portion including at least a first leg and a second leg, each of the first and second legs including an upstream end and a downstream end, the upstream end of the first and second legs being connected by a transverse connector, the upstream portion further including an upstream opening extending between the first and second legs; and a downstream portion connected to the downstream end of each of the first and second legs, the downstream portion including a generally central opening fluidly communicating with the upstream opening.

12. The fuel injector accordingly to claim 11, wherein the restrictor is sized to fit a flow channel.

13. The fuel injector according to claim 12, wherein the flow channel is located in am armature.

14. The fuel injector according to claim 12, wherein the restrictor is adjustably located within the flow channel.

15. A method of reducing bounce in an armature/needle assembly of a fuel injector comprising:

providing an armature reciprocably located within the fuel injector, the armature having an upstream end, a downstream end, and a channel extending therethrough having an upstream portion and a downstream portion;

inserting a flow restrictor element into the downstream portion of the channel, the flow restrictor element in the channel allowing flow from the upstream end toward the downstream end, but restricting flow from the downstream end toward the upstream end; and operating the fuel injector.

16. The method according to claim 15, further comprising adjusting a location of the flow restrictor in the channel, the location of the flow restrictor in the channel determining fluid flow through the fuel injector.

17. A method of setting a fuel flow rate in a fuel injector comprising:

a) providing a fuel injector having an armature, the armature including an upstream end, a downstream end, and a channel extending therethrough;

b) inserting a flow restrictor into the channel, the flow restrictor restricting fuel flow through the channel;

c) operating the fuel injector;

d) measuring a fuel flow rate through the fuel injector;

e) adjusting a location of the flow restrictor in the channel;

f) repeating steps c-e until a desired fuel flow rate is achieved; and g) securing the flow restrictor to the armature.

* * * * *